US008783601B1

(12) United States Patent
Shala

(10) Patent No.: US 8,783,601 B1
(45) Date of Patent: Jul. 22, 2014

(54) WET WIPE ROLL DISPENSING SYSTEM

(76) Inventor: Gzim Shala, Yonkers, NY (US)

( * ) Notice: Subject to any disclaimer, the term of this patent is extended or adjusted under 35 U.S.C. 154(b) by 503 days.

(21) Appl. No.: 13/170,918

(22) Filed: Jun. 28, 2011

(51) Int. Cl.
*B65H 75/18* (2006.01)

(52) U.S. Cl.
USPC ..... 242/596.8; 242/598.6

(58) Field of Classification Search
USPC ..... 242/588, 588.3, 588.6, 595, 596, 596.4, 242/596.5, 596.7, 596.8, 598, 598.3, 598.5, 242/598.6
See application file for complete search history.

(56) References Cited

U.S. PATENT DOCUMENTS

| | | | | | |
|---|---|---|---|---|---|
| 187,604 | A * | 2/1877 | Dempster | 242/588.6 |
| 2,462,776 | A * | 2/1949 | Price | 242/598.6 |
| 3,310,353 | A * | 3/1967 | Cordis | 312/34.4 |
| 4,802,632 | A | 2/1989 | Fukuda et al. | |
| 5,660,313 | A * | 8/1997 | Newbold | 225/42 |
| 5,680,978 | A * | 10/1997 | Pinion | 225/106 |
| 5,697,577 | A * | 12/1997 | Ogden | 242/598.6 |
| 5,765,717 | A * | 6/1998 | Gottselig | 221/45 |
| 5,897,074 | A * | 4/1999 | Marino | 242/594.1 |
| 6,056,235 | A * | 5/2000 | Brozinsky | 242/598.6 |
| 6,343,491 | B1 | 2/2002 | Jung | |
| 6,536,707 | B2 * | 3/2003 | Adelakun | 242/598.6 |
| 7,059,493 | B2 * | 6/2006 | Welchel et al. | 221/34 |
| 7,294,378 | B2 | 11/2007 | Rivera et al. | |
| 2002/0096597 | A1 * | 7/2002 | Adelakun | 242/588.6 |
| 2007/0221778 | A1 * | 9/2007 | Gullo | 242/598.6 |
| 2009/0200328 | A1 | 8/2009 | Hoefing et al. | |
| 2009/0256022 | A1 * | 10/2009 | Maurer | 242/560.1 |
| 2010/0025419 | A1 | 2/2010 | Yaros | |
| 2013/0126665 | A1 * | 5/2013 | Fournier | 242/598.6 |

* cited by examiner

*Primary Examiner* — William A Rivera
(74) *Attorney, Agent, or Firm* — Crossley Patent Law; Micah C. Gunn

(57) ABSTRACT

A wet wipe roll dispensing system including a housing attached to a recessed toilet paper holder, the housing having pivotally attached first and second portions with a slot therebetween from which to individually dispense wet wipes from a roll rotatingly secured to spring-loaded rods engaging a notch on each side of the housing, the wet wipes having a semi-circular tab for grasping one of the wipes.

3 Claims, 3 Drawing Sheets

WET WIPE ROLL DISPENSING SYSTEM

BACKGROUND OF THE INVENTION

Various types of wet wipe dispensing systems are known in the prior art. However, what is needed is a wet wipe roll dispensing system that attaches to a recessed toilet paper holder including a housing having pivotally attached first and second portions with a slot therebetween from which to individually dispense wet wipes from a roll rotatingly secured to a spring-loaded rod disposed across a chamber inside the housing, the wet wipes having a semi-circular tab for grasping one of the wipes.

FIELD OF THE INVENTION

The present invention relates to dispensing systems for wet wipes, and more particularly, to a wet wipe roll dispensing system.

SUMMARY OF THE INVENTION

The general purpose of the present wet wipe roll dispensing system, described subsequently in greater detail, is to provide a wet wipe roll dispensing system which has many novel features that result in a wet wipe roll dispensing system which is not anticipated, rendered obvious, suggested, or even implied by prior art, either alone or in combination thereof.

To accomplish this, the present wet wipe roll dispensing system includes a housing designed to attach to a recessed toilet paper holder. The housing has a first portion having a concave center portion with front and rear edges, a semi-circular first side, and a semi-circular second side as well as a second portion having a concave central portion with forward and rearward edges, a semi-circular first end, and a semi-circular second end. At least one hinge is disposed between the first portion center portion rear edge and the second portion central portion rearward edge to pivotally attach the first center portion to the second portion central portion rearward edge. The first portion and the second portion operationally engage each other in an open position as shown in FIG. 6 for placement of a roll of wet wipes therein and in an alternate closed position as shown in FIGS. 2 and 3 for containing the roll of wet wipes. A continuous chamber is disposed between the first portion and the second portion operationally engaged in a closed position. A slot is disposed between the center portion front edge and the central portion forward edge. A semi-circular notch is centrally disposed on each of a lower edge of the center portion first and second sides, and an upper edge of the central portion first and second ends. A spring-loaded rod engages each notch. Each rod further has an outer portion and an inner portion that slidingly engages a continuous interior wall of the outer portion to permit the separation of the rod thus allowing a roll of wet wipes to be rotatingly secured to the rod. Each of the rod right end and rod left end is configured to engage an aperture of a respective right side mount and left side mount of the toilet paper holder so that the roll of wet wipes rotate around the rod. Each wet wipe includes an outer edge and an opposite perforated inner edge as well as a semi-circular tab centrally disposed on the outer edge, wherein the tab protrudes outwardly from the outer edge. A semi-circular indentation is centrally disposed on the inner edge. The chamber of the housing is configured to removably contain the wet wipes therein. The slot is configured to removably receive the outer edge and the inner edge of each of the wet wipes therethrough upon the operational engagement of the first portion and the second portion in the closed position. The slot has a short height to prevent the wet wipes from drying out. The tab is configured to extend outwardly from the chamber through the slot upon the operational engagement of the first portion and the second portion in the closed position. The tab allows a user to easily grasp a single wet wipe for individual use while also permitting a majority of the wet wipe to remain inside the housing to also prevent the drying out of the wet wipe and the wet wipes remaining on the roll inside the housing.

The present device increases the convenient availability of wet wipes for use as a toilet paper replacement, for use to provide relief in connection with hemorroids and rashes, and for use to clean a user's hands, even when no sink is available.

The housing has a height of approximately 4 inches and a diameter of approximately 4 inches. The wet wipes includes both flushable wipes and non-flushable wipes. The housing is provided in a wide variety of colors and ornamental designs thereon. The housing is reusable. In addition, a recycled plastic material is preferably used to form the housing; however, other materials that are suitable for the purposes of the present invention may also be used. The wet wipes are provided in both scented and non-scented materials.

Thus has been broadly outlined the more important features of the present wet wipe roll dispensing system so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
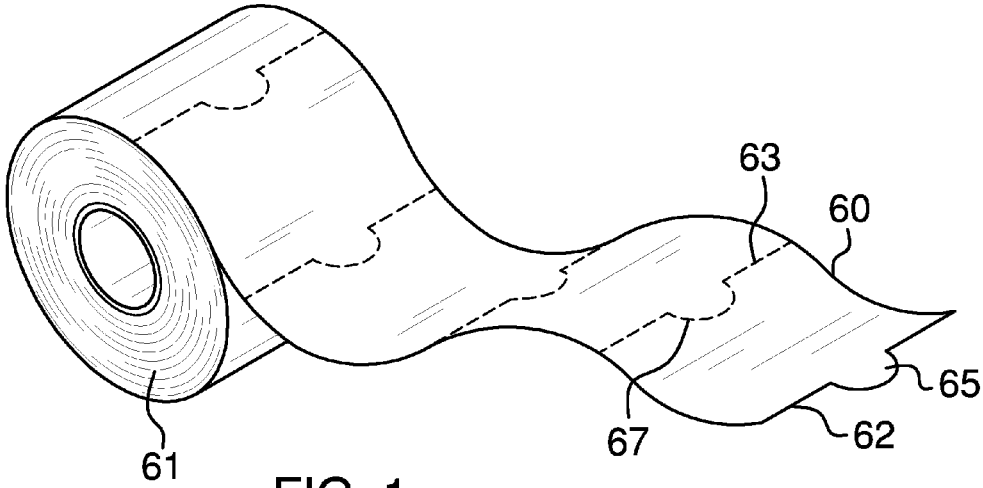
FIG. 1 is an isometric view of a roll of wet wipes.

With reference now to the drawings, and in particular FIGS. 1 through 6 thereof, example of the instant wet wipe roll dispensing system employing the principles and concepts of the present wet wipe roll dispensing system and generally designated by the reference number 10 will be described.

Referring to FIGS. 1 through 6 a preferred embodiment of the present wet wipe roll dispensing system 10 is illustrated. The wet wipe roll dispensing system 10 includes a housing 20 configured to attach to a recessed toilet paper holder 90. The housing 20 has a first portion 21 having a concave center portion 23, a semi-circular first side 25, and a semi-circular second side 27. The center portion 23 has a front edge 28 and a rear edge 29. The housing 20 also has a second portion 30. The second portion 30 has a concave central portion 32, a semi-circular first end 34, and a semi-circular second end 35. The central portion 32 has a forward edge 37 and a rearward edge 38.

Figure 2:
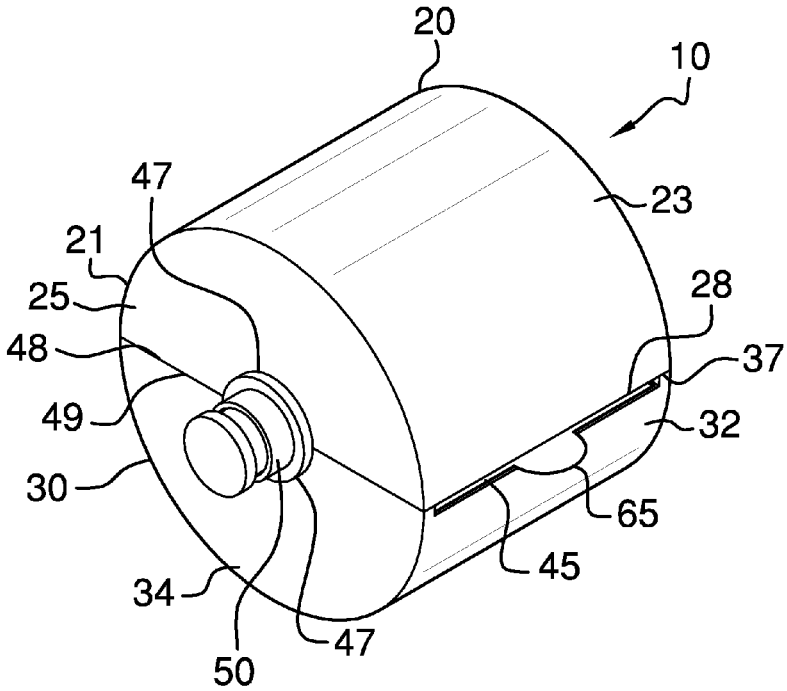
FIG. 2 is an isometric view of a dispenser.
Figure 3:
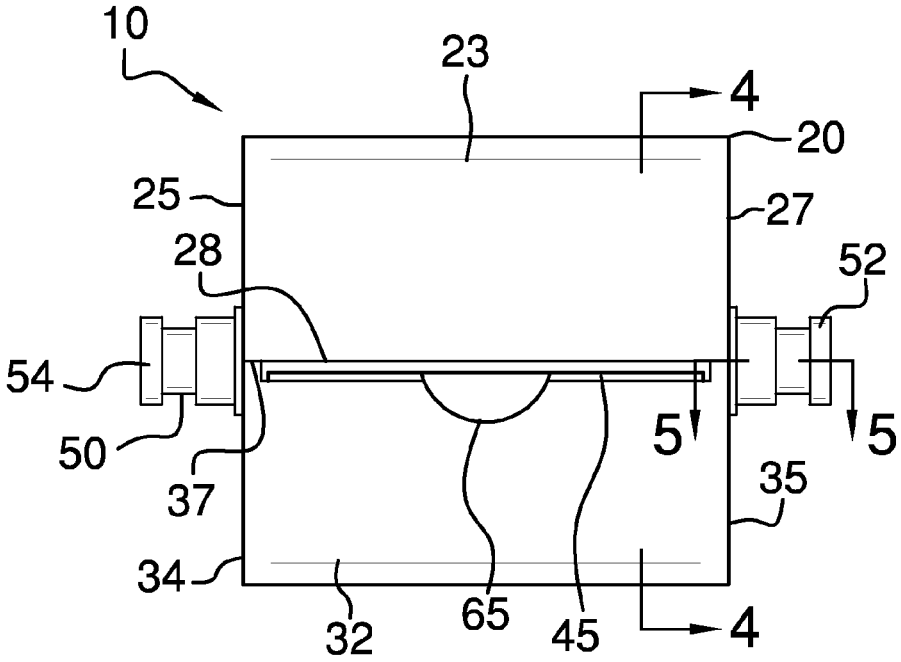
FIG. 3 is a front elevation view of the dispenser with the roll of wet wipes disposed therein.
Figure 4:
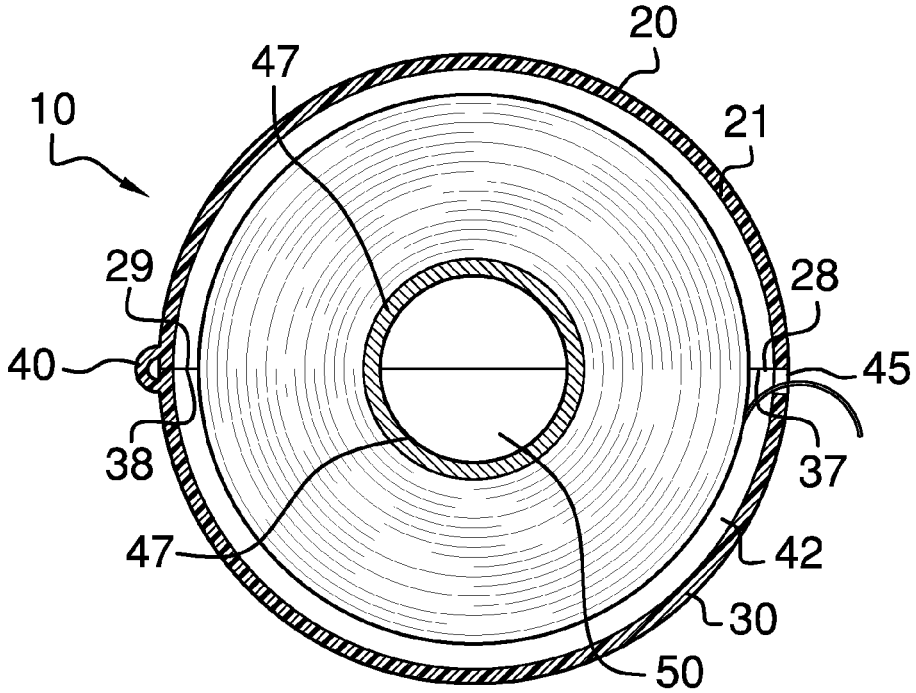
FIG. 4 is a cross-sectional view taken along line 4-4 of FIG. 3.
Figure 5:
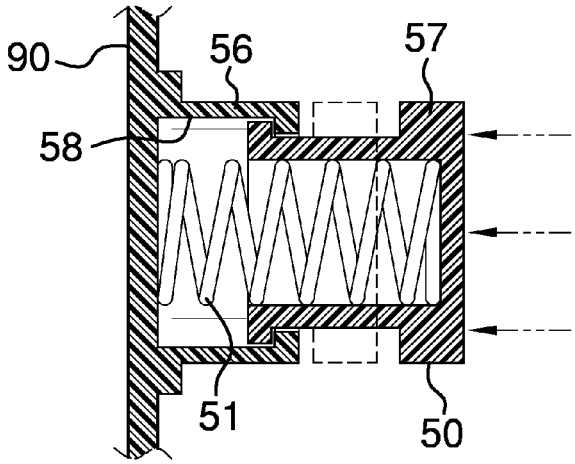
FIG. 5 is a cross-sectional view taken along line 5-5 of FIG. 3.
Figure 6:
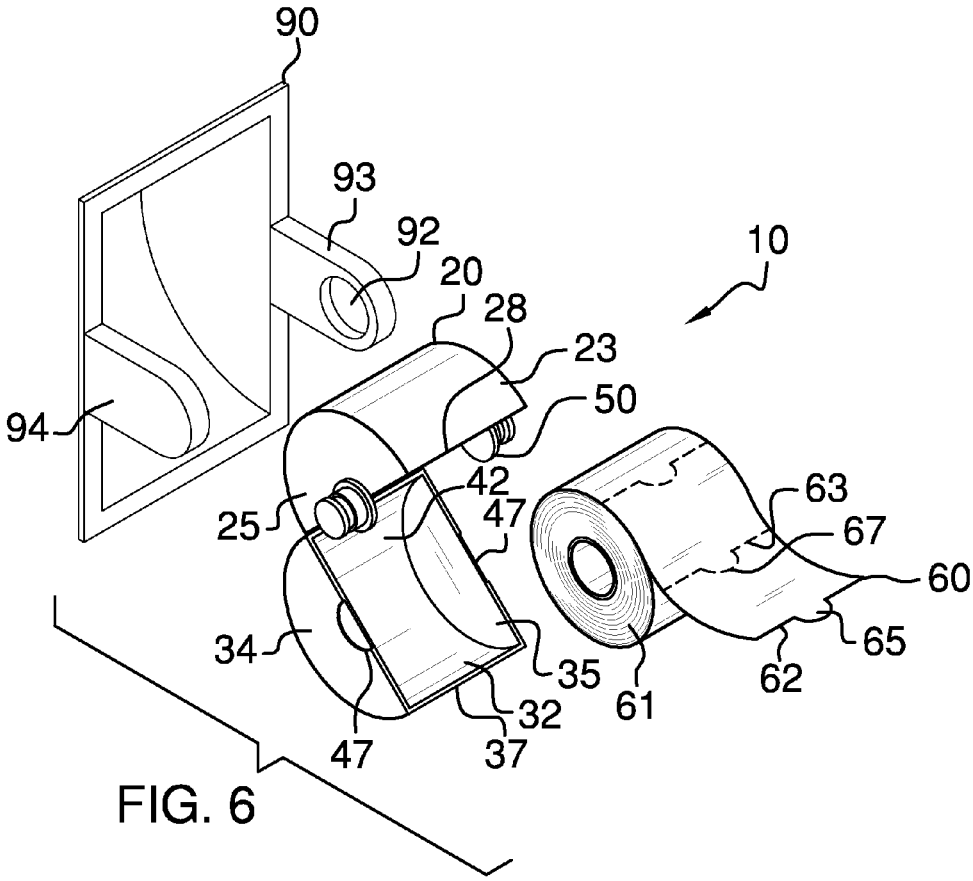
FIG. 6 is an exploded isometric view.

At least one hinge 40 is disposed between the first portion 21 center portion 23 rear edge 29 and the second portion 30 central portion 32 rearward edge 38. The first portion 21 center portion 23 rear edge 29 is pivotally attached to the second portion 30 central portion 32 rearward edge 38. The first portion 21 and the second portion 30 operationally engage each other in an open position as shown in FIG. 6 and in an alternate closed position as shown in FIGS. 2 and 3. A continuous chamber 42 is disposed between the first portion 21 and the second portion 30 operationally engaged in a closed position. A slot 45 is disposed between the center portion 32 front edge 28 and the central portion 32 forward edge 37.

A semi-circular notch 47 is centrally disposed on each of a lower edge 48 of the center portion 32 first and second sides 25, 27 and an upper edge 49 of the central portion 32 first and second ends 34, 35. A spring-loaded rod 50, having a continuous spring 51 therein, is engages each notch 47. Each rod 50 further has an outer portion 56 and an inner portion 57 that slidingly engages a continuous interior wall 58 of the outer portion 56 to permit the separation of the rods 50 thus allowing a roll of wet wipes 60 to be secured to the rod 50. Each of the rod 50 right end 52 and rod left end 54 is configured to engage an aperture 92 of a respective right side mount 93 and left side mount 94 of the toilet paper holder 90.

A plurality of wet wipes 60 is also included. The wet wipes 60 are disposed in a roll configuration 61. The roll of wet wipes 60 rotatably engages the rod 50. Each wet wipe 60 includes an outer edge 62 and an opposite perforated inner edge 63 as well as a semi-circular tab 65 centrally disposed on the outer edge 62, wherein the tab 65 protrudes outwardly from the outer edge 62. A semi-circular indentation 67 is centrally disposed on the inner edge 63. The tab 65 and perforated inner edge 63 allows a user to easily grasp a single wet wipe 60 for use while also permitting a majority of the wet wipe 60 to remain inside the housing 20 to prevent wet wipes 60 from drying out. As the wet wipes 60 are individually dispensed, the indentation 67 on the perforated inner edge 63 of the wet wipe 60 being dispensed becomes the tab 65 on the next wet wipe 60 to be dispensed.

The chamber 42 of the housing 20 is configured to removably contain the wet wipes 60 therein. The slot 45 is configured to removably receive the outer edge 62 and the inner edge 63 of each of the wet wipes 60 therethrough upon the operational engagement of the first portion 21 and the second portion 30 in the closed position. The slot 45 has a short height to prevent the wet wipes 60 from drying out. The tab 65 is configured to extend outwardly from the chamber 42 through the slot 45 upon the operational engagement of the first portion 21 and the second portion 30 in the closed position.

What is claimed is:

1. A wet wipe roll dispensing system comprising:

a housing configured to attach to a recessed toilet paper holder, the housing comprising:

a plurality of outer walls comprising a first portion and a second portion pivotally attached to the first portion;

the first portion having a concave center portion, a semi-circular first side, and a semi-circular second side, wherein the center portion has a front edge and a rear edge;

the second portion having a concave central portion, a semi-circular first end, and a semi-circular second end, wherein the central portion has a forward edge and a rearward edge;

a chamber disposed within the outer walls;

a continuous slot disposed along a center horizontal axis between a front edge of the first portion and a forward edge of the second portion;

a semi-circular notch centrally disposed on each of a lower edge of the center portion first and second sides and an upper edge of the central portion first and second ends;

a rod engaging each notch, wherein each rod has an outer portion and an inner portion removably slidingly engaging the outer portion;

a plurality of wet wipes are disposed in a roll configuration;

wherein the roll of wet wipes rotatably engage the rods;

wherein each wet wipe comprises:

an outer edge and an opposite perforated inner edge;

a semi-circular tab centrally disposed on the outer edge, wherein the tab protrudes outwardly from the outer edge;

a semi-circular indentation centrally disposed on the inner edge;

wherein the chamber is configured to removably contain the wet wipes therein;

wherein the slot is configured to removably receive the outer edge and the inner edge of each of the wet wipes therethrough upon the operational engagement of the first portion and the second portion in a closed position; and wherein the tab is configured to extend outwardly from the chamber through the slot upon the operational engagement of the first portion and the second portion in a closed position.

2. A wet wipe roll dispensing system comprising:

a housing configured to attach to a recessed toilet paper holder, the housing comprising:

a first portion having a concave center portion, a semi-circular first side, and a semi-circular second side, wherein the center portion has a front edge and a rear edge;

a second portion having a concave central portion, a semi-circular first end, and a semi-circular second end, wherein the central portion has a forward edge and a rearward edge;

at least one hinge disposed between the first portion center portion rear edge and the second portion central portion rearward edge;

wherein the first portion center portion rear edge is pivotally attached to the second portion central portion rearward edge;

wherein the first portion and the second portion operationally engage each other in an open position and in an alternate closed position;

a continuous chamber disposed between the first portion and the second portion operationally engaged in the closed position;

a slot disposed between the center portion front edge and the central portion forward edge;

a semi-circular notch centrally disposed on each of a lower edge of the center portion first and second sides and an upper edge of the central portion first and second ends;

a spring-loaded rod engaging each notch, wherein each rod has an outer portion and an inner portion removably slidingly engaging the outer portion;

a plurality of wet wipes, wherein the wet wipes are disposed in a roll configuration;

wherein the roll wet wipes rotatably engage the rod;

wherein each wet wipe comprises:

an outer edge and an opposite perforated inner edge;

a semi-circular tab centrally disposed on the outer edge, wherein the tab protrudes outwardly from the outer edge;

a semi-circular indentation centrally disposed on the inner edge;

wherein the chamber is configured to removably contain the wet wipes therein;

wherein the slot is configured to removably receive the outer edge and the inner edge of each of the wet wipes therethrough upon the operational engagement of the first portion and the second portion in the closed position;

wherein the tab is configured to extend outwardly from the chamber through the slot upon the operational engagement of the first portion and the second portion in the closed position.

3. The wet wipe roll dispensing system of claim 2 wherein the inner portion removably slidingly engages a continuous interior wall of the outer portion.

* * * * *